United States Patent [19]

Matthew et al.

[11] Patent Number: 4,531,681

[45] Date of Patent: Jul. 30, 1985

[54] FLEXIBLE DISK REFINER AND METHOD

[75] Inventors: John B. Matthew; Edward C. Kirchner, both of Pittsfield, Mass.

[73] Assignee: Beloit Corporation, Beloit, Wis.

[21] Appl. No.: 486,006

[22] Filed: Apr. 18, 1983

[51] Int. Cl.[3] ..... B02C 7/14

[52] U.S. Cl. ..... 241/146; 241/261.3; 241/285 R

[58] Field of Search ..... 241/296, 297, 298, 259.1, 241/259.2, 161, 162, 163, 261.2, 261.3, 250, 251, 253, 261, 28, 300, DIG. 30, 102, 146, 285 R

[56] References Cited

U.S. PATENT DOCUMENTS

| | | | |
|---|---|---|---|
| 122,129 | 12/1871 | Myers | 241/DIG. 30 X |
| 360,670 | 4/1887 | Etnier, Jr. | 241/DIG. 30 X |
| 2,718,178 | 9/1955 | Wandel | 92/20 |
| 3,371,873 | 3/1968 | Thomas | 241/163 |
| 4,167,250 | 9/1979 | McMillin et al. | 241/251 |

FOREIGN PATENT DOCUMENTS

| | | | |
|---|---|---|---|
| 527395 | 7/1956 | Canada | 241/163 |

*Primary Examiner*—Mark Rosenbaum

*Attorney, Agent, or Firm*—Hill, Van Santen, Steadman & Simpson

[57] ABSTRACT

An apparatus and method for reducing particulate material such as paper making pulp between radially extending relatively rotatable and axially confronting refining surfaces between which the material must pass while being refined during relative rotation of the surfaces. The refining surfaces are mounted on resiliently flexible disks for operating pressure responsive clearance adjustment of the relatively rotating refining surfaces axially relative to one another, for attaining optimum material refining results from the refining surfaces.

20 Claims, 5 Drawing Figures

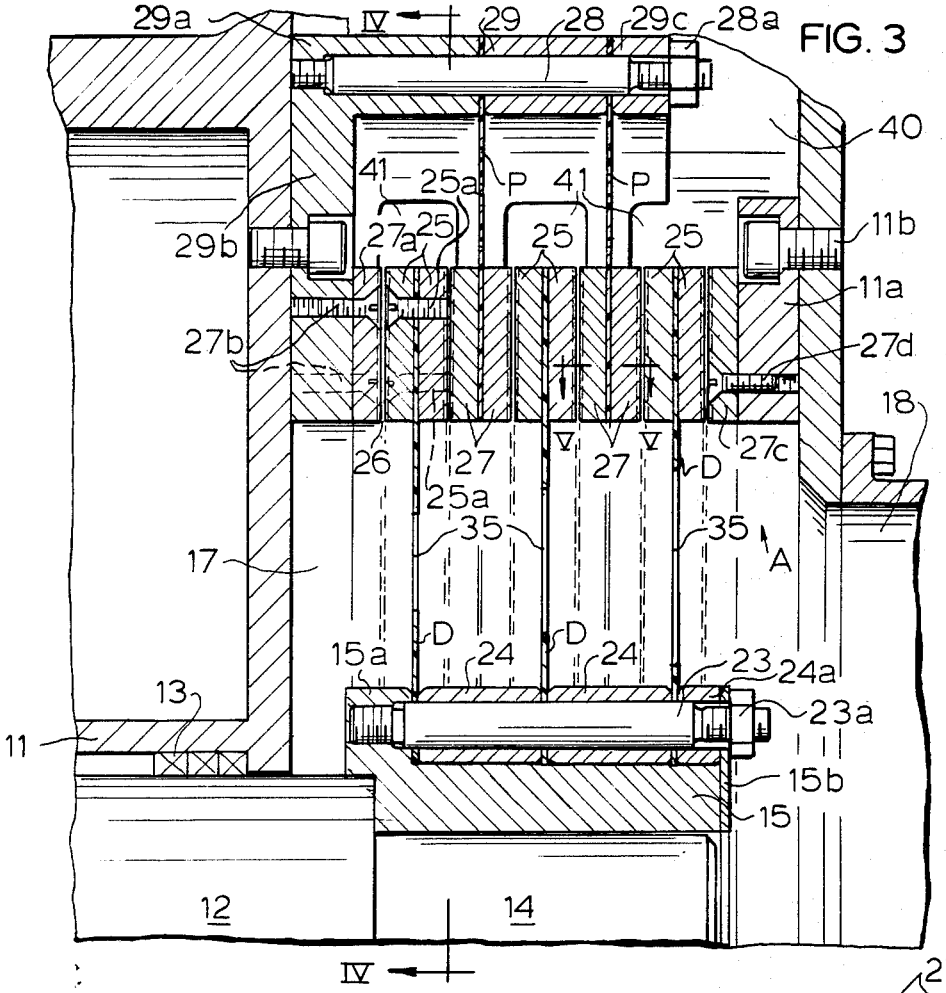
FIG. 3
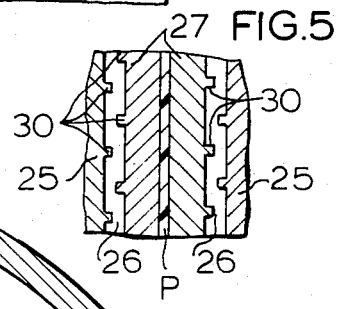
FIG.5
FIG. 4
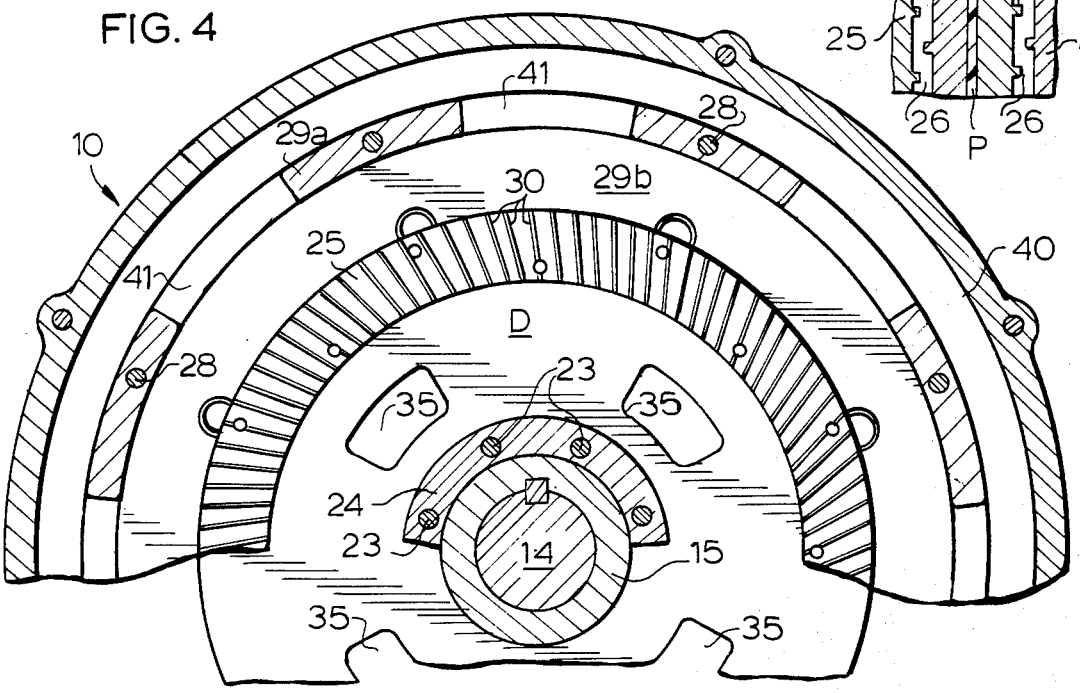

FLEXIBLE DISK REFINER AND METHOD

BACKGROUND OF THE INVENTION

1. Field of the Invention

The present invention relates to machines for effecting a refining treatment of materials, and more particularly refining fibrous pulp materials for the manufacture of paper or paperboard.

2. Description of Prior Art

Present methods of refining paper stock, as it comes from the beaters, digesters, or other pulping machines, involve usually passing the stock between grinding or refining surfaces which break up the fibrous materials and effect some further separation and physical modification of the fibers.

Typical pulp refiners or grinders, such as disclosed in U.S. Pat. No. 3,371,873, have a rotating disk provided on one or both sides with annular refining surface means. The disk refining surfaces face non-rotating annular grinding surfaces and define refining zones in which the pulp is worked. The rotating disk and its refining surfaces are made of a relatively inflexible material, such as cast iron or ni-hard stainless steel. The non-rotating grinding surfaces are made of like material and rigidly mounted so as to resist the torque created by the rapidly rotating disk and the pressure on the pulp material passing through the refining zone gap. Axial adjustment of the refining zone gaps is effected by axial shifting of the shaft on which the disk is mounted.

These rigid disk refiners must be manufactured and assembled to exacting tolerances in order to rigidly set the refining zone gap widths. Because the structural loads applied during the refining process to the rigid disk are large, a bulky and extremely rugged design is necessary so that the refining surface relationships do not change under load. This results in the rigid disk refiners being very costly due to the necessarily close tolerance machining, the need for large quantities of high strength disk material, the bulky overall structure, the restricted machine capacity, and the excessive assembly time requirements.

SUMMARY OF THE INVENTION

An object of the present invention is to avoid the rigidity constraints typically heretofore required for rotary disk refiners and like apparatus. As a result, massive support and alignment structures may be eliminated, a less costly refiner machine can be produced, and greater capacity and efficiency attained without increasing envelope or housing size or power requirements as compared with conventional systems.

To this end, the present invention provides in an apparatus for reducing particulate material between a plurality of radially extending relatively rotatable and axially confronting refining surfaces between which the material must pass while being refined during relative rotation of the surfaces, and means for effecting flow of the material radially between and across the surfaces, the improvement comprising resiliently flexible refining surface supporting means permitting operating pressure responsive adjustment of the relatively rotating refining surfaces axially relative to one another for attaining optimum material working results from the refining surfaces.

The invention also provides in a method of reducing particulate material between a plurality of radially extending relatively rotatable and axially confronting refining surfaces between which the material must pass while being refined during relative rotation of the surfaces, the improvement comprising effecting flow of the material radially between and across the surfaces, and effecting operating pressure responsive adjustment of the relatively rotating refining surfaces axially relative to one another by means of resiliently flexible refining surface supporting means and thereby attaining optimum material refining results from the refining surfaces.

In more particular aspects of the present invention, a pulp refiner is provided wherein ring-shaped refining surface plates of limited radial width are mounted on interleaved margins of axially resiliently flexible or deflectable disk elements. Disk margins spaced from the interleaved margins on one set of the disk elements are secured to a rotor while the margins on another set of the disks are secured non-rotatably or counter-rotatably. The refining surface plates are adapted to be made of suitable hard, substantially rigid material. On the other hand, the disk elements are adapted to be made of axially resiliently flexible material which strongly resists deformation in radial and circumferential directions. As a result of the manner in which the axially flexible disk elements are supported, automatic axial self-adjustment of the refining surfaces is effected during the pulp refining process for attainment of optimum refining action by the relatively rotating refining surfaces.

BRIEF DESCRIPTION OF THE DRAWINGS

Other objects, features and advantages of the present invention will be readily apparent from the following description of a representative embodiment thereof, taken in conjunction with the accompanying drawings, although variations and modifications may be effected without departing from the spirit and scope of the novel concepts embodied in the disclosure, and in which:

FIG. 3 is a fragmentary, enlarged sectional detail view taken substantially along the line III—III of FIG. 1;

FIG. 4 is a fragmentary sectional elevational detail view taken substantially along the line IV—IV of FIG. 3; and FIG. 5 is a fragmentary, enlarged sectional detail view taken substantially along the line V—V of FIG. 3.

DETAILED DESCRIPTION

Figure 1:
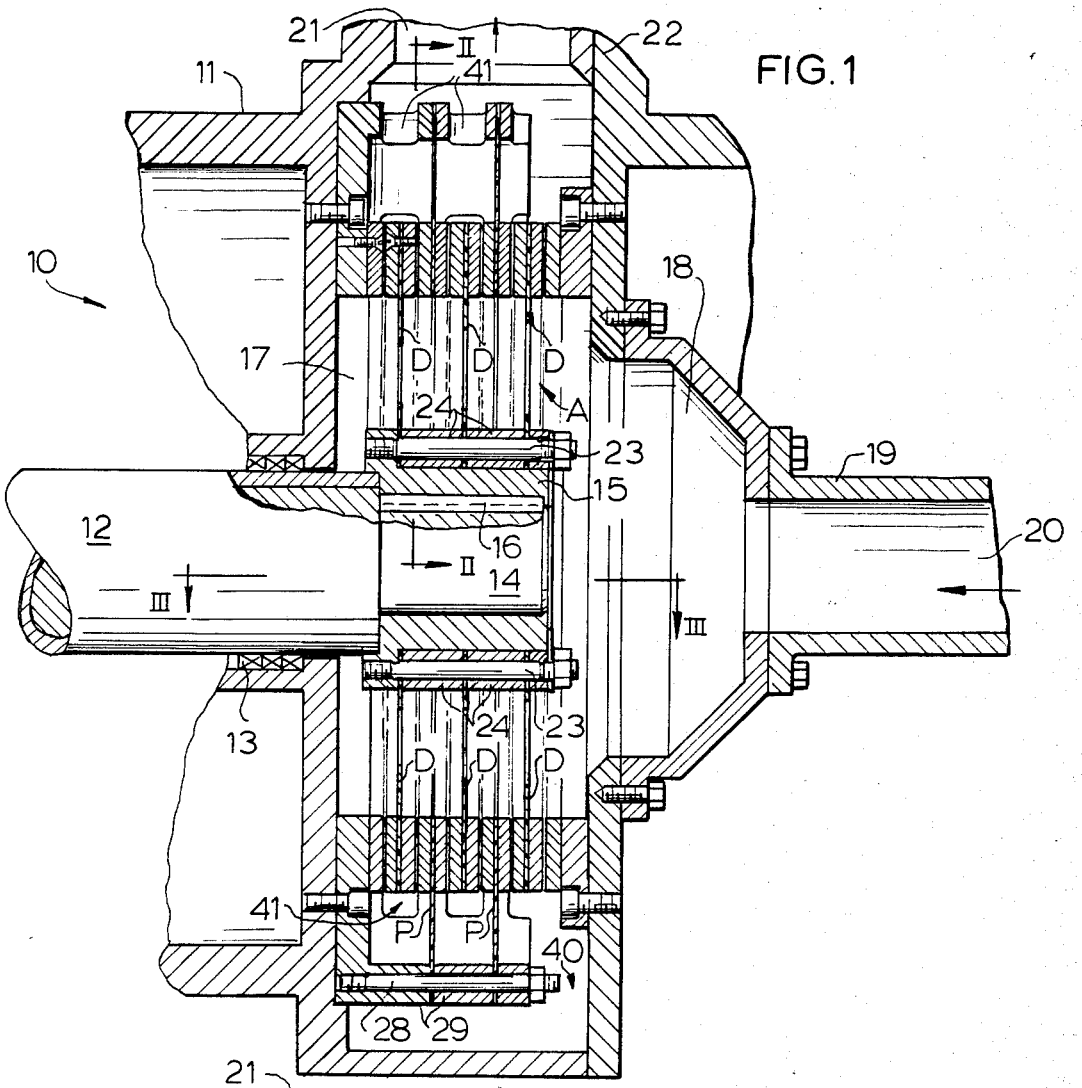
FIG. 1 is a longitudinal sectional elevational view through a flexible disk pulp refiner constructed in accordance with the present invention.

A flexible disk refiner assembly 10 embodies the present invention and is adapted for reducing and fibrillating various fibrous materials into individual fibers. The assembly 10 is particularly adapted for use in the paper making industry for refining wood pulp in preparing paper making stock. Although shown as a single unit, the refiner assembly 10 may be one of a series of refiners employed where in the pulp refining process the pulp fibers must be progressively reduced.

In a preferred arrangement, the assembly 10 includes a stationary, chambered housing 11 in which a shaft 12 is supported for rotation on conventional bearing means including a bearing structure 13, and is adapted to be driven by a suitable motor (not shown). A stub 14 is provided on the free end of the shaft 12, and a hub or rotor 15 mounted on the stub is held by key means 16 corotative with the stub.

Within the housing there is defined a refining, working chamber 17 into which the shaft stub 14 projects and within which the rotor 15 is operative for effecting rotation of part of a pulp fiber refining means A to which pulp stock is desirably directed by way of an inlet 18 coaxial with the hub 15. The pulp stock is delivered to the inlet 18 by means of a pipe 19 which desirably has its passage 20 coaxial with the hub 15. After treatment by the refining means A, the refined pulp stock is adapted to leave the working chamber 17 by way of a tangential or radial outlet 21 defined by outlet structure 22 at the perimeter of the chamber 17. It may be noted that while the flow pattern for the stock through the working chamber 17 is shown as from the inlet 18 to the outlet 21, the flow may, if preferred, be reversed to that the outlet 21 becomes and inlet and the inlet 18 becomes an outlet, because the refining action of the refining means A does not depend upon the particular direction of flow under hydraulic pressure.

In a preferred construction, the refining means A comprises at least one rotor mounted disk D (FIGS. 1, 3 and 4), but there may as many of the disks D as preferred for any particular installation, three being shown herein by way of example. Central clearance holes in the disks D enable mounting of the disks on the hub 15. Clamping ring and bolt means comprising bolts 23 secure the inner margins of the disks D to the rotor. Ring spacers 24 serve to maintain predetermined axial spacing of the disks. Adjacent to one end of the rotor 15 the bolts 23 are desirably threadedly engaged with an annular attachment flange 15*a* or the rotor 15. At the opposite end of the rotor 15 the bolts 23 carry nuts 23*a* threaded thereon and driven against an annular retainer ring 15*b* engaging the end of the hub 15 and thrusting against a clamping ring 24*a* engaging the adjacent disk margin and thrusting it against the contiguous spacer 24 and so on toward the shoulder provided by the flange 15*a*.

Each of the disks D carries on each side of its radially outer margin radially extending refining surfaces provided by means of respective ring-shaped refining plates 25 which may be secured as by means of screws 25*a* to one another and concentrically to the associated disk margin sandwiched therebetween.

Figure 2:
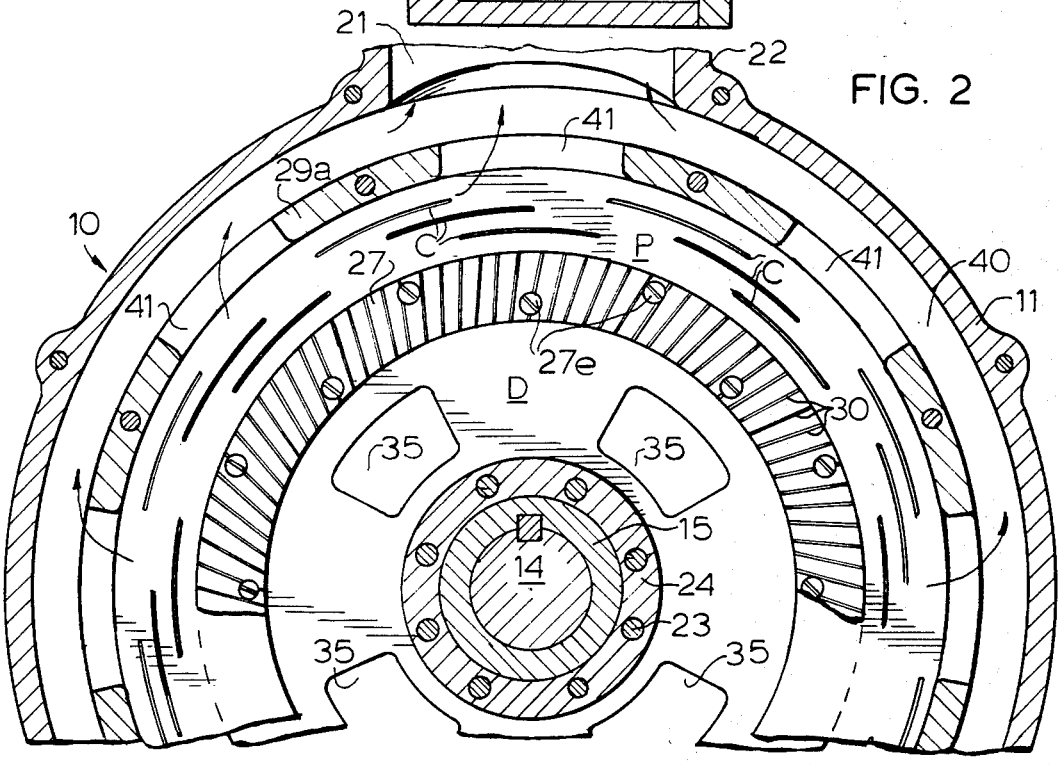
FIG. 2 is a fragmentary, sectional elevational detail view, taken substantially along the line II—II of FIG. 1.

Cooperating in substantially interleaved relation with the refining surface plates 25, and providing therewith radially extending refining gaps or zones 26, are coaxial ring-shaped and preferably radially coextensive refining surface plates 27 carried on inner margins of disks P. A pair of the plates 27 is secured to the sandwiched carrying disk margin by means such as screws 27*e* (FIG. 2). At their radially outer margins the disks P are secured by means of bolts 28 to a clamping and spacer ring structure comprising an intermediate spacer ring 29, and an axially extending annular spacer flange 29*a* on a radially extending plate 29*b* bolted to the housing 11 and to which one end of the bolts 28 are secured. At the opposite ends of the bolts 28, nuts 28*a* threaded on the bolts thrust a clamping ring 29*c* axially toward the intermediate ring 29. Thereby the disks P are marginally clamped in a stator relation to the rotor relation of the disks D.

It should be remembered, however, that although the two sets of disks D and P are in a rotor/stator relationship, a reverse relationship may be provided if preferred, wherein the disks D are in a stator relationship to a rotor relationship of the disks P. Also, if preferred, one of the sets of disks D and P may be caused to rotate in one rotary direction and the other set of disks P may be caused to rotate in the opposite rotary direction. In principle, however, it is necessary in the refining process for there to be relative rotation of the disks D and P, and more particularly relative rotation of the refining surfaces on the plates 25 on the one hand and the confronting refining surfaces on the plates 27 on the other hand.

In order to complete the refining surface relationship at the opposite axial ends of the refining means A, a refining surface plate 27*a* is secured as by means of screws 27*b* to the ring plate 29*b* whereby to provide a refining gap 26 with the juxtaposed refining plate 25 surface. At the axially opposite end of the refining means A, a refining plate 27*c* is secured as by means of screws 27*d* to a mounting ring plate 11*a* secured as by means of screws 11*b* to the adjacent wall of the housing defining the inlet side of the working chamber 17. Through this arrangement, all of the fibrous stock or slurry that enters the working chamber 17 through the inlet 18 must pass through the refining zones 26 defined by the relatively rotatable and axially confronting refining surfaces provided by the plates 25 on the one hand and the cooperating plates 27, 27*a* and 27*c* on the other hand.

In order to enhance the refining action of the refining surfaces of the plates 25 and 27, the refining surfaces of the plates 25 have a continuous array of generally radially extending narrow ribs 30 and alternating substantially wider grooves, and the refining surfaces of the refining plates 27 have a similar annular array of narrow generally radially extending narrow refining ribs 30 and intervening wider grooves. Enhanced refining action is attained by having the ribs 30 on the refining surfaces of the ring plates 27 biased diagonally in one circumferential direction, as shown in FIG. 2, while the refining ribs 30 on the refining surfaces of the ring plates 25 are diagonally biased in the opposite circumferential direction, as seen in FIG. 4.

In order to attain substantially equal flow of the particulate material to be reduced, i.e. paper making pulp stock, to each of the refining surface zones 26, the rotor disks D have flow openings 35 therethrough in a circumferentially spaced array. For low consistency stock the holes 35 may be of substantially the same size in all of the disks D. For higher consistency stock the holes 35 may vary in size from largest size in the disk nearest to the inlet 18 and then progressively smaller holes in the disks progressively spaced from the disk which is nearest to the inlet.

Radially outwardly relative to the cooperating refining plates 25 and 27, means are provided for collecting and promoting flow of the refined material to the outlet 21. To this end, an annular collecting subchamber 40 is provided about the radially outer side of the refining plate and disk structure A, and in which the refined material is collected and directed to the outlet 21. In order to enhance radial flow from the downstream edges of the refining zones 26, to the relatively unobstructed radially outermost area of the collecting subchamber 40, the members of the clamping ring structure comprising the spacers 29 and 29*a* and the clamping ring 29*c*, are desirably provided with circumferentially spaced throughflow passage openings 41.

According to the present invention, the disks D and P provide resiliently flexible mounting means, which are in effect mounting vanes, for the refining plates 25 and 27 permitting operating pressure responsive adjustment of the relatively rotating refining surfaces of the refining plates axially relative to one another for attaining optimum material refining results from the refining surfaces. To this end, the disks D and P desirably comprise relatively thin wall material having a high strength to modulus of elasticity ratio such as Scotchply reinforced plastic type 1002 Crossply or other suitable material such as spring stainless steel or fiberglass, or the like. Selection of material and thickness should be such that the disks are capable of axial resilient deflections, but possessed of thorough resistance to radial and circumferential deflection so as to effectively withstand torque and centrifugal loads in operation. On the other hand, the refining plates 25 and 27, 27*a* and 27*c* are desirably made from a relatively hard and relatively inflexible wear resistant material such as ni-hard stainless steel, ceramic, or the like. It may be noted that the rotor disks D are about three times wider than the plates 25, and the, in this instance stator, disks P are at least twice as wide as the plates 27. This affords ample areas of the respective disks D and P for resilient flexing adjustment to maintain a desirably substantially equalized relationship between the confronting refining surfaces of the plates 25 and 27 during refining operation. The need for extreme tolerance minimization of critical components of the refining means A is thus avoided, with substantial economic benefits. With respect to the disks D resilient flexibility is enhanced by the flow-through openings 35. In respect to the disks P a pattern of circumferentially extending slits or slots C (FIG. 2) is provided therein for enhanced axial resilient flexibility. As shown, the slots C are preferably arranged in circumferentially staggered and radially spaced relation to one another.

Although a preferred spacing condition for each of the refining zones 26 may be calculated and maintained by proper selection of spacers and mounting members in the assembly, especially where the refining means A is specifically adapted for refining continuously a particular grade of the particulate material to be refined, it may be desirable for situations where different grades of the material must be refined from time to time in the same refiner to provide a conventional loading mechanism (not shown) for setting the axial dimensions of the refining zone gaps 26 whereby to attain the maximum yield for the particular material to be refined. In any event, in the operation of the refiner, the axial resilient flexibility of the disks D and P enables the refining plates 25 and 27 to attain efficient self-alignment and self-centering for uniformity of refining action between the refining surfaces, in response to dynamic fluid pressure exerted by the material caused to traverse the confronting refining surfaces during relative rotation of the refining plates 25, 27, 27*a* and 27*c*.

It will be understood that variations and modifications may be effected without departing from the spirit and scope of the novel concepts of this invention.

We claim as our invention:

1. In an apparatus for reducing particulate material between at least one pair of radially extending relatively rotatable and axially confronting refining surfaces defining an annular gap between which the material must pass while being refined during relative rotation of said surfaces, and means for effecting flow of the material radially through said gap and across said surfaces, the improvement comprising:

at least one of said refining surfaces in said pair comprising an annular rigid refining plate; and a radially extending resiliently flexible mounting vane having two radially spaced portions carrying said plate and extending radially between said plate attached to one of said portions and a supporting means attached to the other of said portions, and flexing to permit substantially axial movement of said rigid refining plate for automatically adjusting said gap for attaining optimum material refining by said refining surfaces.

2. Apparatus according to claim 1, wherein said resiliently flexible mounting vane comprises a disk element which is axially resiliently flexible but resistant to radial and circumferential forces.

3. Apparatus according to claim 2, wherein said disk element has refining surfaces facing in opposite axial directions thereon.

4. Apparatus according to claim 3, wherein said disk comprises a rotor disk.

5. Apparatus according to claim 3, wherein said disk comprises a stator disk.

6. Apparatus according to claim 1, wherein said resiliently flexible mounting vane comprises one of a set of partially interleaved relatively oppositely radially extending axially resiliently flexible disks carrying refining surfaces plates on their interleaved portions, and said supporting means supporting said interleaved disks for relative rotation.

7. Apparatus according to claim 6, wherein said disk set comprises radially inwardly extending disks which are supported on a rotor, and a radially outwardly extending set of interleaved disks are supported on a stator.

8. Apparatus according to claim 6, including a housing about said disks defining a refining chamber providing a flow path across said refining surfaces.

9. Apparatus according to claim 6, including means for enhancing the axial resiliency of said disks.

10. In an apparatus for reducing particulate materials such as paper making pulp:

a housing defining a working chamber having an inlet and an outlet for flow of particulate material through said working chamber;

a rotary shaft supported by said housing and having a rotor mounted on the shaft within said working chamber;

a radially extending annular axially resiliently flexible disk vane mounted fixedly at a center thereof on said rotor for rotation therewith in said chamber and having on a perimeter of the disk spaced substantially from said rotor a rigid annular refining surface;

a complementary rigid refining surface mounted within said chamber and cooperating in confronting relation with said refining surface on said disk vane so that in the relative rotation of said refining surfaces particulate material flowing through said working chamber and between said refining surfaces is refined; and the resilient flexibility of said disk vane enabling clearance self-adjustment of the confronting relationship between said refining surfaces responsive to dynamic fluid pressure of the flowing material.

11. Apparatus according to claim 10, including stator means carried by said housing within said working chamber and mounting said refining surface cooperating with said disk-carried refining surface.

12. Apparatus according to claim 10, wherein said rotor mounted disk vane comprises one of a plurality of similar axially resiliently flexible disk vanes carrying respective refining surfaces and all mounted on said rotor, spacer means maintaining said disk vanes in axially spaced relation to one another on said rotor, and said complementary refining surface comprising one of a plurality of like refining surfaces all supported on second resiliently flexible disk vanes disposed in partially interleaved relation to said rotor mounted disk vanes and extending radially in the opposite direction from said rotor mounted disk vanes, and means supporting said second disk vanes in axially spaced relation to one another and for relative rotary cooperation with said rotor mounted disk vanes.

13. Apparatus according to claim 12, wherein all of said disks have means for enhancing the axially resilient flexibility of the disks.

14. Apparatus according to claim 12, including means for enhancing flow-through of the particulate material in said working chamber past said rotor carried disks and then past said second disks after passing said cooperating refining surfaces.

15. For use in an apparatus for reducing particulate material between a plurality of cooperating pairs of radially extending relatively rotatable and axially confronting rigid refining surfaces in a chamber between which the material must pass while being refined during relative rotation of said surfaces and which includes means for effecting flow of the material radially between and across said surfaces:

a resiliently flexible refining disk vane having radially spaced first and second portions mounted at said first portion in said chamber;

at least one rigid refining surface in each pair being carried by said second portion of said disk vane spaced from said first portion; and said disk vane being adapted for axially resilient flexing between said portions for automatic and continuous pressure responsive axial clearance adjustment of said one rigid refining surface relative to the cooperating refining surface in said pair during operation of said apparatus.

16. A resiliently flexible refining disk vane according to claim 15, which is annular in form and has an annular margin, said refining surface means comprising annular plate means substantially narrower then said disk vane and mounted on said disk margin, and means for securing said plate means to said disk vane margin.

17. A resiliently flexible refining disk vane according to claim 16, wherein said annular margin is at the radially outer perimeter of said disk vane, and a radially inner margin of said disk being adapted for mounting the disk vane in said apparatus.

18. A resiliently flexible refining disk vane according to claim 16, wherein said annular margin is at a radially inner edge of said disk, and said disk vane having a radially outer margin which is adapted to be secured in said apparatus.

19. A resiliently flexible refining disk vane according to claim 16, wherein said refining surface means comprises annular plate structure on both sides of said margin, and means securing said refining plate structure to said margin and clamping said margin between said refining plate structure.

20. A resiliently flexible refining disk vane according to claim 15, wherein said disk vane comprises a relatively thin modulus section material selected from reinforced plastic, fiber glass and spring stainless steel, and said refining plate means comprises wear resistant material selected from ni-hard stainless steel and ceramic.

* * * * *

UNITED STATES PATENT AND TRADEMARK OFFICE

CERTIFICATE OF CORRECTION

PATENT NO. : 4,531,681

DATED : July 30, 1985

INVENTOR(S) : John B. Matthew and Edward C. Kirchner

It is certified that error appears in the above-identified patent and that said Letters Patent are hereby corrected as shown below:

Claim 16, column 8, line 14, insert --vane-- between "disk" and "margin"

Claim 17, column 8, line 19, insert --vane-- between "disk" and "being".

Claim 18, column 8, line 23, insert --vane-- between "disk," and "and".

Signed and Sealed this

*Twenty-sixth* Day of *November 1985*

[SEAL]

*Attest:*

DONALD J. QUIGG

*Attesting Officer*

*Commissioner of Patents and Trademarks*